US006599202B2

(12) United States Patent
Miyamoto

(10) Patent No.: US 6,599,202 B2
(45) Date of Patent: Jul. 29, 2003

(54) GOLF CLUB SET

(75) Inventor: Kenichi Miyamoto, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/768,628

(22) Filed: Jan. 25, 2001

(65) Prior Publication Data

US 2002/0037774 A1 Mar. 28, 2002

(30) Foreign Application Priority Data

Feb. 2, 2000 (JP) ..... 2000-025497
Mar. 7, 2000 (JP) ..... 2000-062484

(51) Int. Cl.[7] ..... A63B 53/04; A63B 53/10; A63B 53/12

(52) U.S. Cl. ..... 473/289; 473/290

(58) Field of Search ..... 473/289, 290, 473/292

(56) References Cited

U.S. PATENT DOCUMENTS 5,575,473 A * 11/1996 Turner
5,795,240 A * 8/1998 Chappell
5,924,936 A * 7/1999 Penley

FOREIGN PATENT DOCUMENTS

GB 2227418 * 8/1990

* cited by examiner

*Primary Examiner*—Stephen Blau
(74) *Attorney, Agent, or Firm*—Birch, Stewart, Kolasch & Birch, LLP

(57) ABSTRACT

A golf club set comprises at least three golf clubs having different loft angles changing progressively from the smallest loft angle of the lowest numbered golf club to the largest loft angle of the highest numbered golf club. Each of the golf clubs comprises a shaft and a head, the head provided with a hosel having a shaft inserting hole into which the shaft is inserted. In a standard state of each golf club in which the head is disposed on a horizontal plane so as to show its lie angle and loft angle, the clubs satisfys the following conditions $$Ln \leqq L(n+1)$$

$$L(n=1) < L(n=m)$$

$$dn \geqq d(n+1)$$

$$d(n=1) > d(n=m)$$

wherein

L is a hosel length, d is an inside diameter of a shaft inserting hole, suffix "n" to "L" and "d" means the order number of the club in the ascending order from the lowest numbered club (n=1) to the highest numbered club (n=m), and m is the number of the golf clubs, and the hosel length of each club is defined as a length measured from the upper end of the hosel to the horizontal plane along the central axis of the shaft.

11 Claims, 14 Drawing Sheets

GOLF CLUB SET

BACKGROUND OF THE INVENTION

The present invention relates to a golf club set in which low-numbered golf clubs are lowered in the gravitational center of the head.

In order to derive full performance from a club which is proper to the number of the club, devices were made with respect to the gravitational center of the head and the moment of inertia of the head.

In general, it is relatively difficult for the average golfers to hit a ball high towards an intended direction with a long iron having a small loft angle for example. Therefore, devices to make the gravitational center of the head lower and deeper were made for such a golf club.

For example, U.S. Pat. Nos. 5,501,459 and 5,807,191 disclose golf clubs of which head is provided with a sole made of a very high specific gravity material. U.S. Pat. No. 539,712 discloses a golf club in which the main portion of the head is formed in a shape of low gravitational center. In the former case, the head tends to become complex. In the later case, the possibility of head design is greatly restricted.

SUMMARY OF THE INVENTION

It is therefore, an object of the present invention to provide a golf club set, in which low-numbered golf clubs can be lowered in the gravitational center of the head, without imposing a complex structure and limiting the head design freedom.

According to the present invention, a golf club set comprises at least three golf clubs having different loft angles changing progressively from the smallest loft angle of the lowest numbered golf club to the largest loft angle of the highest numbered golf club, each of the golf clubs comprising a shaft and a head, the head provided with a hosel having a shaft inserting hole into which the shaft is inserted, in a standard state of each golf club in which the head is disposed on a horizontal plane so as to show its lie angle and loft angle, the clubs satisfying the following conditions $$Ln \leqq L(n+1)$$

$$L(n=1) < L(n=m)$$

$$\text{i } dn \geqq d(n+1)$$

$$d(n=1) > d(n=m)$$

wherein

L is a hosel length, d is an inside diameter of a shaft inserting hole, suffix "n" to "L" and "d" means the order number of the club in the ascending order from the lowest numbered club (n=1) to the highest numbered club (n=m), and m is the number of the golf clubs, and the hosel length of each club is defined as a length measured from the upper end of the hosel to the horizontal plane along the central axis of the shaft.

DESCRIPTION OF THE PREFERRED EMBODIMENTS

As preferred embodiments of the present invention, an iron club set and a wood-type golf club set will now be described in detail in conjunction with the accompanying drawings. It is however, also possible to apply the present invention to various golf club sets, e.g. utility golf club set in which club head shapes are between the iron type and wood type, and the like. In case of wood type golf club set, the present invention is preferable applied to fairway wood sets not including a driver (#W1).

Iron Club Set

As an embodiment of the present invention, an iron golf club set will now be described in detail in conjunction with FIGS. 1–4.

The iron club set comprises at least three iron clubs having different loft angles.

Preferably, the iron set includes the third iron (#3), fourth iron (#4), fifth iron (#5), sixth iron (#6), seventh iron (#7), eighth iron (#8) and ninth iron (#9). Further, one or more of the first iron (#1), second iron (#2), pitching-wedge (PW), approach-wedge (AW), sand-wedge (SW), lob-wedge (LW) can be added thereto.

In this embodiment, the iron set includes ten iron clubs #3, #4, #5, #6, #7, #8, #9, PW, AW and SW. Nominal numbers have been given to the pitching-wedge (PW), the approach-wedge (AW) and the sand-wedge (SW). Accordingly, the ninth iron (#9)<PW<AW<SW. The sand-wedge (SW) is regarded as the highest numbered iron having the highest nominal club number.

Figure 1:
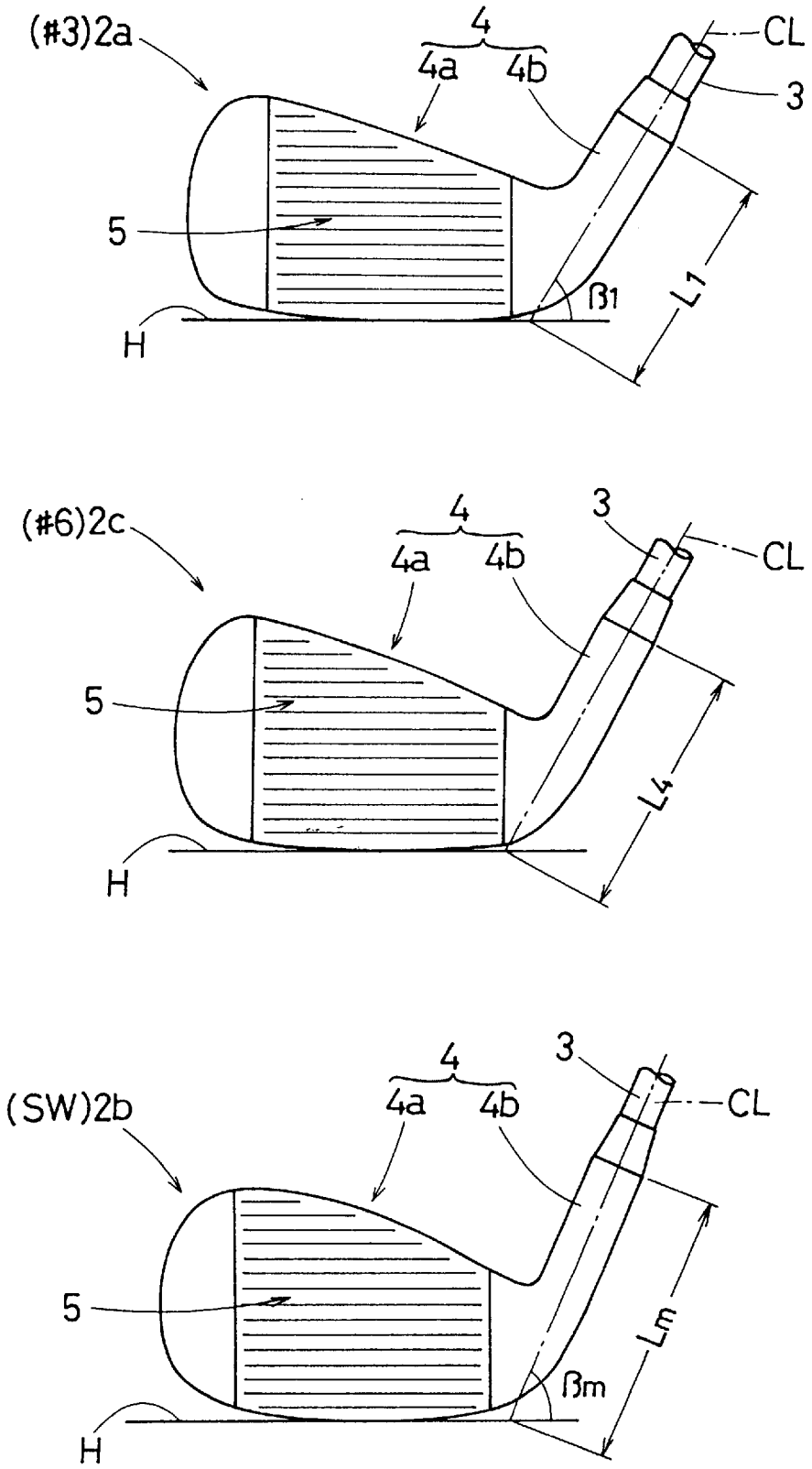
FIG. 1 shows front views of three iron clubs of an iron club set according to the present invention.
Figure 2:
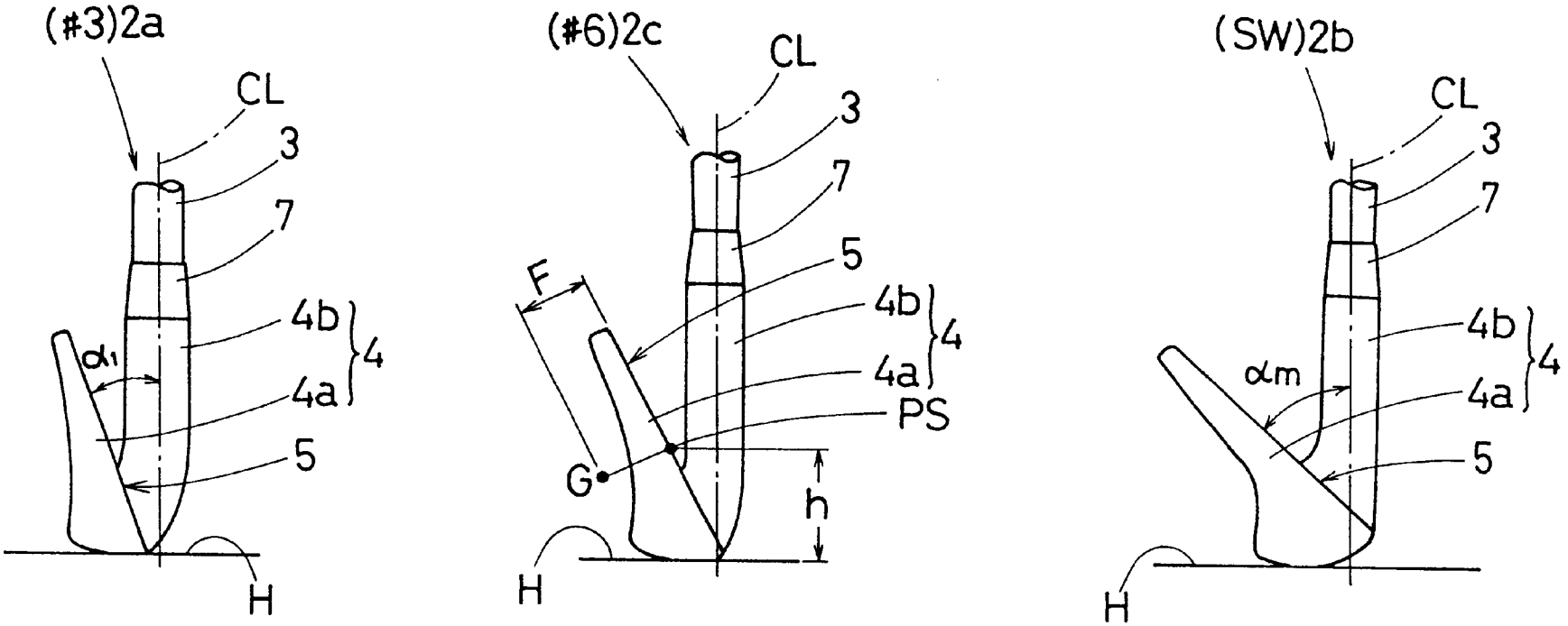
FIG. 2 shows side views of the three iron clubs

FIG. 1 and FIG. 2 exemplary show a minimum set comprising the third iron (#3) as the lowest numbered iron 2*a*, the sand-wedge (SW) as the highest numbered iron 2*b* and the sixth iron (#6) as an intermediate iron 2*c*.

In the golf club set, the clubs are changed in the loft angle $\alpha$ progressively from the smallest loft angle $\alpha$1 for the lowest numbered club 2*a* to the largest loft angle $\alpha$m for the highest numbered club 2*b*. The difference in the loft angle $\alpha$ between a club and the next numbered club is set in a range of from 3 to 6 degrees. And the lengths of the golf clubs are gradually decreased as the loft angle increases.

Figure 3:
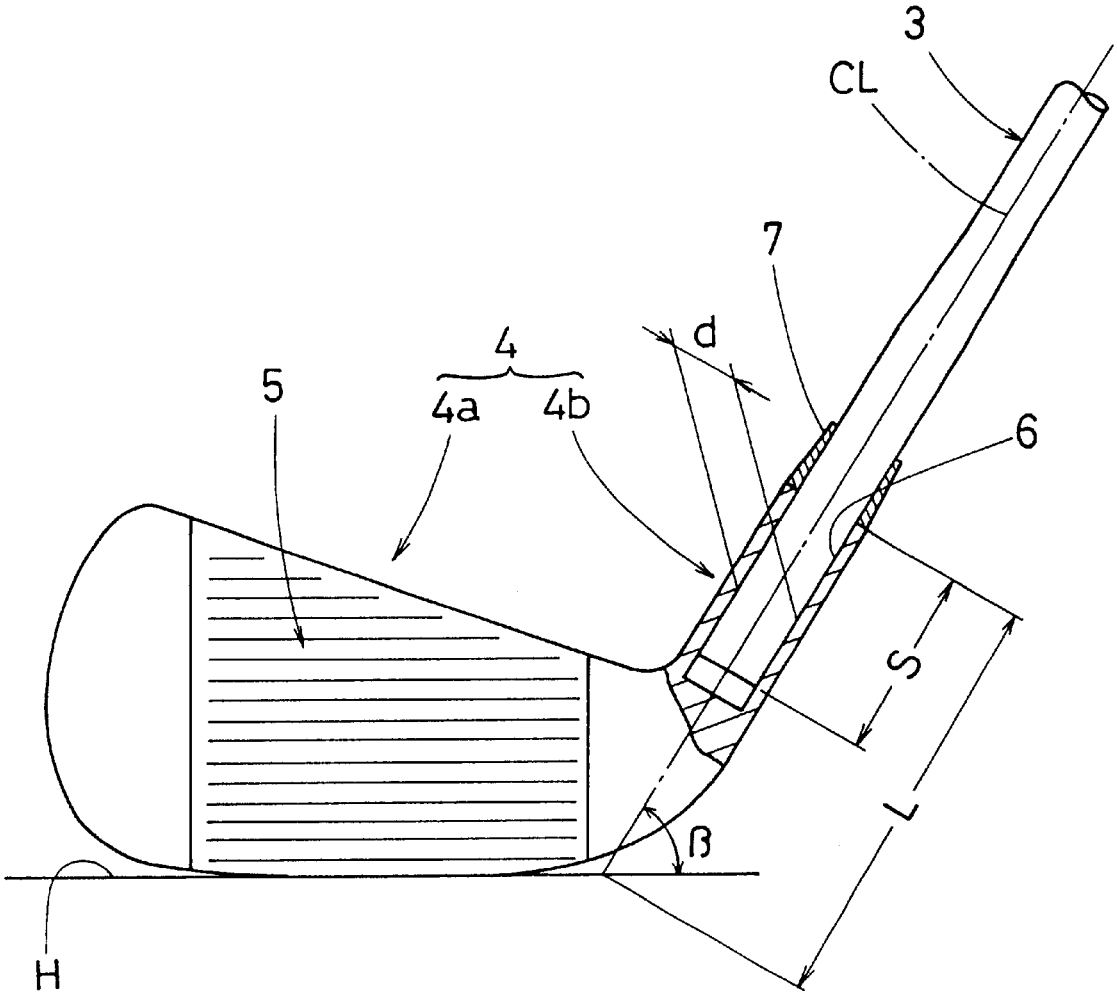
FIG. 3 shows a front view of an iron club.

As shown in FIG. 3, each club 2 comprises a shaft 3 and a head 4.

The head 4 comprises a main part 4*a* which is provided with a face 5 for hitting a golf ball, and a hosel 4*b* which is provided integrally with the main part 4*a* on the heel side of the main part 4*a* and to which a lower end of the shaft 3 is fixed.

The head 4 is made of one or more kinds of metallic materials, for example a stainless steel such as SUS630, by a casting method.

In order to make the face 5, for example, it is possible to provide a face plate integrally with the main part 4*a*, which face plate is made of a low specific gravity material such as titan, titan alloy and the like.

The hosel 4*b* is a pipe-like part provided with a shaft inserting hole 6, into which the lower end of the shaft 3 is inserted.

The shaft inserting hole 6 is a circle in its cross section, and in this embodiment the inside diameter thereof is substantially constant in the depthwise direction. The inside diameter (d) of the shaft inserting hole 6 is slightly, about 0.05 to 0.10 mm, larger than the outside diameter of the shaft 3.

For example, the hosel 4*b* and the shaft 3 are fixed to each other by means of a bonding agent. The shaft inserting hole 6 can be provided on the inner surface with a thread groove to be capable of holding a sufficient bonding agent after the shaft is inserted.

At the upper end of the hosel 4*b*, there is disposed a sleeve 7 which is a short pipe-like part having an outside diameter gradually decreasing upward and thus having a conical outer face to bridge between the hosel and shaft and improve the appearance.

In FIGS. 1–3, the golf clubs are shown in the respective standard states.

The standard state of a club is, irrespective of the head types (iron, wood etc.), that the central axis CL of the shaft 3 is placed in a vertical plane and the head 4 is placed on a horizontal plane H so as to show its loft angle $\alpha$ and lie angle $\beta$.

Under the respective standard states, all the clubs in the club set satisfy the following conditions:

$$Ln \leqq L(n+1)$$

$$L(n=1) < L(n=m)$$

$$dn \geqq d(n+1)$$

$$d(n=1) > d(n=m)$$

wherein

L is a length of the hosel of a club which is measured along the central axis CL of the shaft 3 from the upper end of the hosel 4*b* to the horizontal plane H, d is the inside diameter of the shaft inserting hole 6 of the club, the suffix "n" to "L" and "d" means the order number of the club in the ascending order namely from the lowest numbered club 2*a* (n=1) to the highest numbered club 2*b* (n=m), and m is the number of the clubs, that is, the maximum number of "n".

Preferably, the hosel lengths L are gradually or continuously decreased from the highest numbered club 2*b* to the lowest numbered club 2*a*.

As shown in FIG. 2(*b*), the hosel 4*b* usually projects upward above the gravitational center G of the head 4. Therefore, by decreasing the length of the hosel 4*b*, the gravitational center of the head 4 can be lowered.

In the lowest numbered club 2*a* which the average golfers are weak in dealing with, by setting the hosel length L to be shortest, the gravitational center G of the head 4 is lowered. As a result, it becomes also possible to make the center G deeper so as to be able to hit a ball higher and towards the intended direction. On the other hand, it is relatively easy for the average golfers to deal with high-numbered club because of its larger loft angle. In such high-numbered club, therefore, even if the hosel length L is not decreased, the possibility of miss shot seems remote and it is possible to avoid hitting the ball too high. Thus, it is possible to derive full performance from a club proper to the number of the club.

When the ratio Lm/L1 is excessively small, it is difficult to derive the above-mentioned merits. When the ratio Lm/L1 is excessively large, it is difficult for low-numbered clubs to obtain a sufficient bonding strength between the hosel and shaft 3. In high numbered club, the gravitational center of the head 4 tends to become unfavorably high.

Therefor, the ratio Lm/L1 is preferably set in a range of from 1.05 to 1.50, more preferably 1.10 to 1.35.

For the iron clubs, it is preferable to set the hosel lengths L in a range of from 45 to 75 mm, more preferably in a range of from 48 to 55 mm.

If the hosel length is less than 45 mm, it is difficult to obtain even the minimum bonding strength. If the hosel length is more than 75 mm, the gravitational center G of the head 4 becomes unfavorably high.

To ensure a sufficient bonding strength between the shaft 3 and hosel 4*b*, the inside diameter (d) of the shaft inserting hole 6 is gradually increased from the highest numbered club 2*b* to the lowest numbered club 2*a* to thereby prevent the bonded area from decreasing although the hosel length L is decreased.

If the ratio d1/dm of the inside diameter d1 of the lowest numbered club 2*a* to the inside diameter dm of the highest numbered club 2*b* is excessively small, it is difficult to provide a sufficient bonding area in low numbered clubs. If the ratio d1/dm is excessively large, the difference in appearance of the head especially the hosel 4*b* becomes excessively large.

It is therefore, preferable to set the ratio d1/dm in a range of from 1.05 to 1.50, more preferably in a range of from 1.10 to 1.35.

The inside diameters (d) are preferably set in a range of from 9.2 to 13.0 mm, more preferably in a range of from 9.5 to 13.0 mm.

For the shaft 3, various types may be used, for example, such as steel shafts, fiber reinforced plastic shafts etc.

In this example, the shaft 3 is formed by winding a prepreg around a mandrel into a multi-layered pipe, and then heating the pipe to harden the resin. The prepreg is a sheet of parallel reinforcing fibers impregnated with a thermosetting resin. In this method, the outside diameter of the shaft 3 can be changed easily by increasing or decreasing the number of the layers. Aside from this seat winding method, various methods can be adopted to make the shaft 3, for example, a tape wrapping method, filament winding method and the like.

As to the outside diameter Da of a shaft main part 3*a* between the head 4 and a grip part on the opposite end, all the clubs have the substantially same outside diameter Da. In this example, the diameter Da is constant from the head to the grip part. However, it is possible to gradually decrease the diameter Da towards the head. This diameter Da is accommodated to the inside diameter dm of the smallest inserting hole 6 of the highest numbered club 2*b*. In the highest numbered club 2*b*, therefore, the main part 3*a* having the outside diameter Da is extended to the lower end, and a lower end part thereof is directly inserted into the inserting hole 6.

Figure 4:
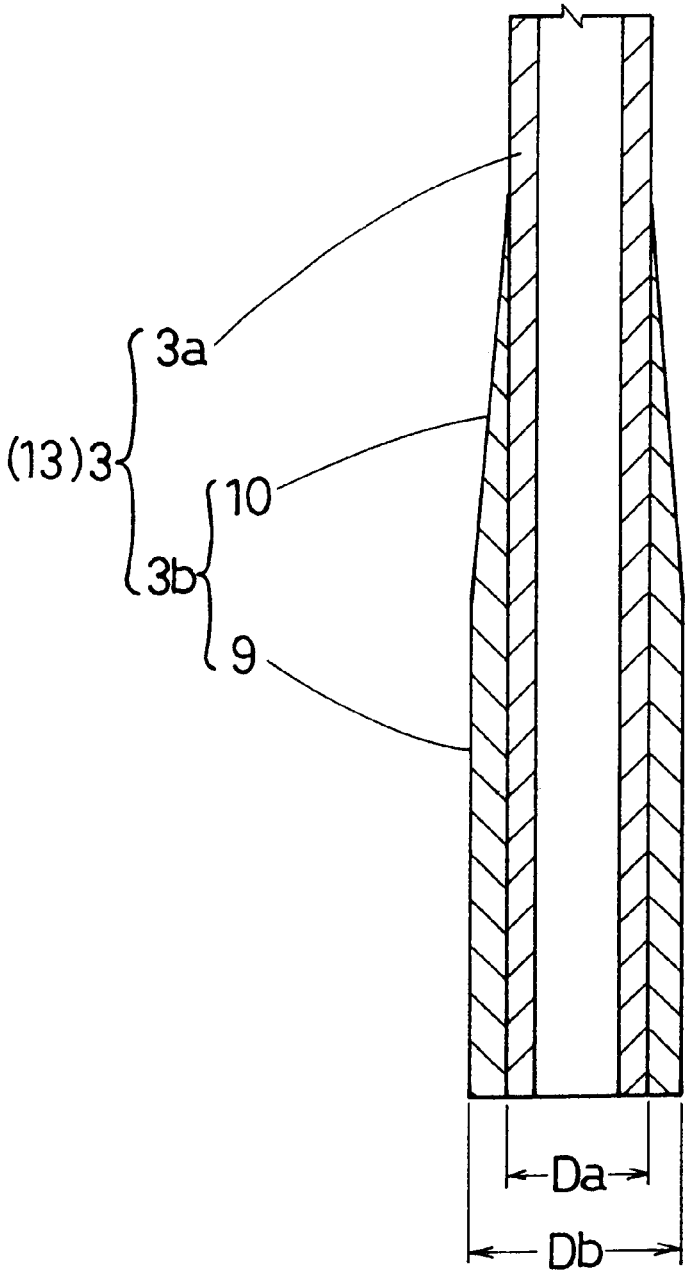
FIG. 4 is a cross sectional view of the lower end part of a shaft.

The shaft 3 for the larger shaft inserting hole 6 is, as shown in FIG. 4, provided in the lower end with a thick part 3*b* so as to fit the hole.

The thick part 3*b* can be formed by winding a prepreg around the main part 3*a* so as to be integrated with the main part 3*a* by heat hardening.

In the prepreg for forming the thick part 3*b*, for example, carbon fiber, glass fiber, metallic fiber, e.g. boron, titan, tungsten, stainless steel, copper, alumina etc. organic fiber, e.g. aramid fiber and the like can be used alone or in combination, as the reinforcing fiber. For the thermosetting resin, epoxy resin, unsaturated polyester resin, phenol resin, vinylester resin and the like can be used alone or in combination.

In the thick part 3*b*, the outside diameter is constant in a portion 9 from the lower end to a position slightly above the upper end of the sleeve 7. But, in a subsequent portion 10, the outside diameter is continuously decreased upward so as to merge into the main portion, whereby the rigidity of the shaft 3 has a gradual change between the thick part and main part to prevent the shaft from breaking at a point therebetween.

In this embodiment, further, the reinforcing fiber in the prepreg for forming the thick part has an elastic modulus lower than that of the main part 3*a*, thereby being capable of avoiding an excessive difference of the bending rigidity of the thick part from that of the main part.

As to the length of a part of the shaft which part is inserted into the shaft inserting hole 6 and bonded thereto (hereinafter the "inserting length S" of the shaft), it is preferable that $$S(n=1)<S(n=m)$$

$$Sn \leqq S(n+1)$$

wherein the suffix "n" is as explained above, the order number of the club in the ascending order.

Further, as to the ratio Sm/S1 of the inserting length Sm of the highest numbered club 2*b* to the inserting length S1 of the lowest numbered club 2*a*, it is preferable that Sm/S1 is in a range of from 1.05 to 1.50, more preferably in a range of from 1.10 to 1.35.

Further, the bonding area of the shaft 3 to the shaft inserting hole 6 is substantially constant through the club set, namely from the lowest numbered club 2*a* to the highest numbered club 2*b*. In this embodiment, the bonding area is set in a range of from 720 to 920 sq.cm, more preferably 800 to 900 sq.cm. The above-mentioned hosel length L, inserting length S and inside diameter (d) are so determined. The "substantially constant" bonding area means that the difference of the maximum bonding area a2 from the minimum bonding area a1 is less than 0.5%, preferably less than 0.1% of the minimum bonding area a1. Incidentally, the bonding area is defined as a product of the inserting length S and the circumference of the shaft inserting hole 6 which circumference can be calculated from the diameter (d).

By setting the bonding area as explained above, it becomes possible to widen the range of adjustment of the gravitational center of the head 4 while maintaining the bonding strength without increasing the weight of the head 4.

Wood Club Set

As an embodiment of the present invention, a wood golf club set will now be described in conjunction with FIGS. 5 and 6. The description is brief to avoid duplication with the above description of the iron set.

The wood club set comprises wood type golf clubs 12 having different loft angles (hereinafter the "wood club").

The wood clubs 12 in this embodiment are at least three fairway wood clubs, that is, three or more of clubs selected from third wood (#W3), fourth wood (#W4), fifth wood (#W5), seventh wood (#W7) and ninth wood (#W9). A driver or first wood (#W) is not included.

Figure 5:
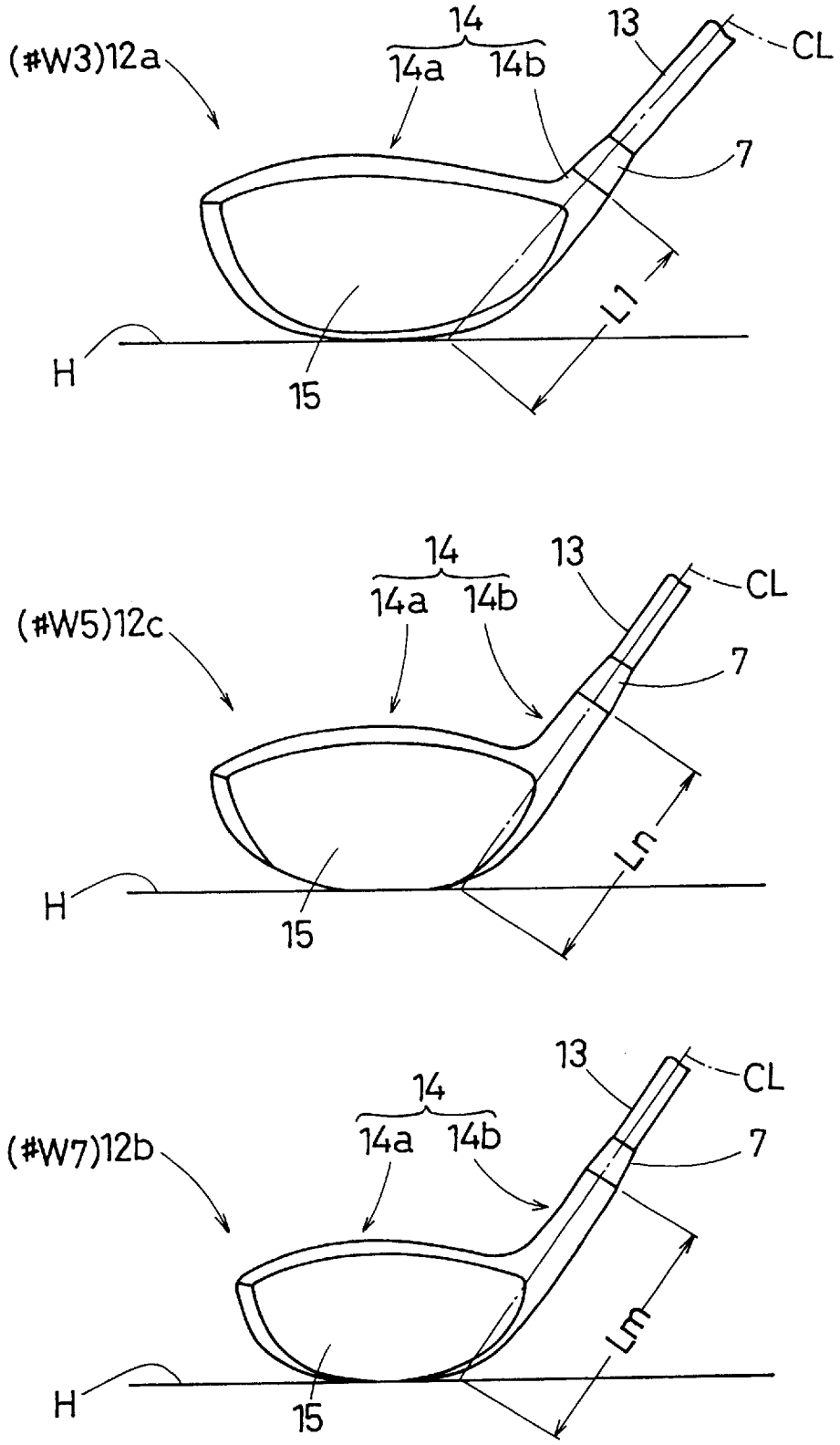
FIG. 5 shows front views of three wood type golf clubs of a wood club set according to the present invention.

FIG. 5 exemplary shows a minimum set comprising the third wood (#W3) as the lowest numbered club 12*a*, the seventh wood (#W7) as the highest numbered club 12*b*, and the fifth wood (#W5) an intermediate club 12*c*.

Figure 6:
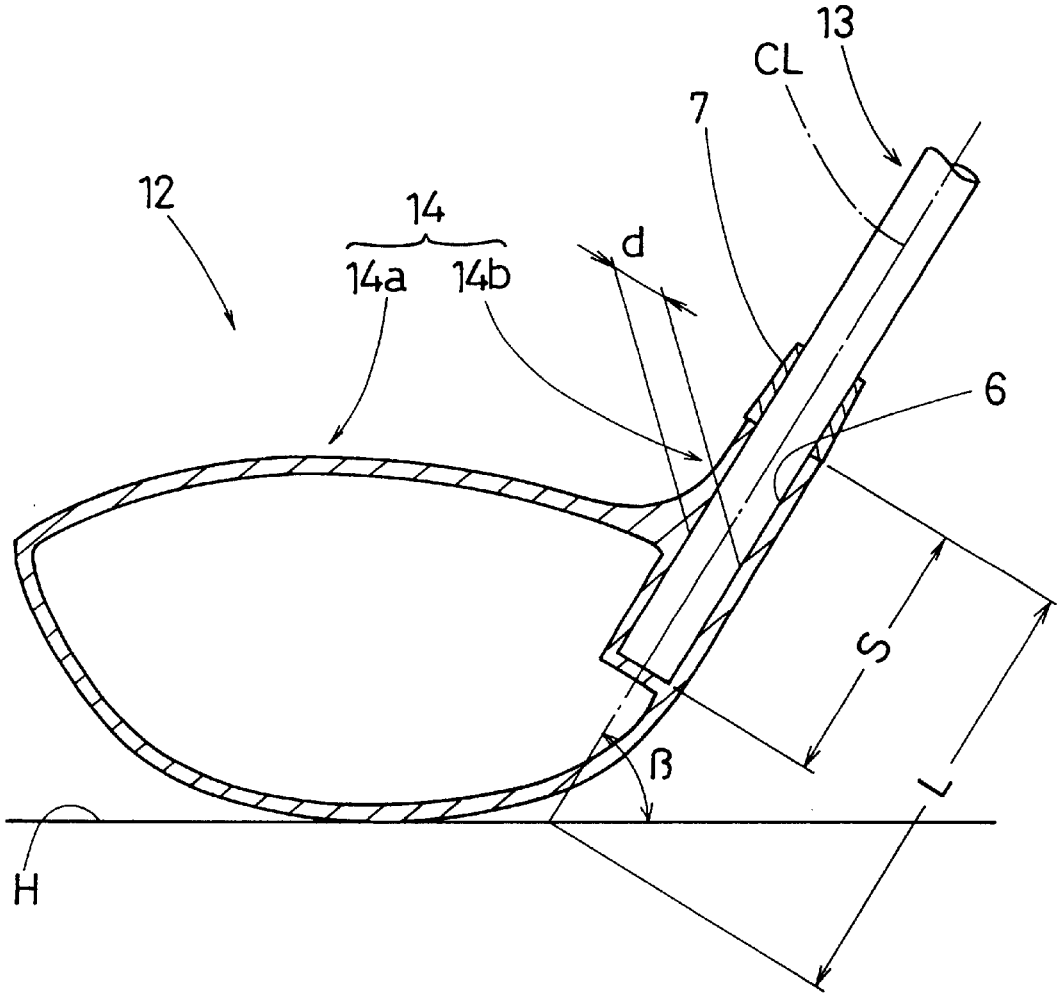
FIG. 6 is a sectional view of a wood type golf club.

FIG. 6 shows the standard state of a wood club 12. The meaning of the standard state has been explained in the above iron club set.

In the wood set, the wood clubs are changed in the loft angle progressively from the smallest loft angle of the lowest numbered club 12*a* to the largest loft angle of the highest numbered club 12*b*. The difference in the loft angle between a club and the next numbered club is about 2 to 3 degrees. The wood clubs are gradually decreased in the club length as the loft angle increases.

Each club 12 comprises a shaft 13 and a head 14.

In this embodiment, the head 14 comprises a hollow main part 14*a* provided with a face 15 for hitting a ball and a hosel 14*b* which is provided on the heel side of the main part 14*a* and to which the lower end of the shaft 13 is fixed.

The head 4 is made of one or more kinds of metallic materials. The head 4 in this example is a precision casting of titan alloy (6Al-4V), namely a metalwood.

Under the standard state, all the clubs in the wood club set satisfy the above-mentioned following conditions:

$$Ln \leqq L(n+1)$$

$$L(n=1)<L(n=m)$$

$$dn \geqq d(n+1)$$

$$d(n=1)>d(n=m).$$

In the lowest numbered wood club 12*a*, the gravitational center G of the head 14 becomes lowered, and it becomes possible to increase the depth of the gravitational center G. Thus, it becomes easy to hit the ball higher and towards the intended direction to increase the carry. In the highest numbered wood club 12*b*, on the contrary, eve if the gravitational center is relatively high, the possibility of miss shot seems remote, and favorably such a relatively high gravity center can prevent the hit ball from rising excessively. Thus, It is possible derive full performance from a club proper to the number of the club.

Further, the ratio Lm/L1 of the hosel length Lm of the highest numbered club 12*b* to the hosel length L1 of the lowest numbered club 12*a*, and the ratio d1/dm of the inside diameter dm of the shaft inserting hole of the highest numbered club 12*b* to the inside diameter d1 of the shaft inserting hole 6 of the lowest numbered club 12*a* are limited in the same manner as the iron set.

In case of wood clubs, however, the hosel length L is preferably set in a range of from 35 to 60 mm, more preferably in a range of from 45 to 52 mm. If the hosel length is shorter than 35 mm, it is difficult to obtain a necessary bonding length. If the hosel length is more than 60 mm, the gravitational center G of the head 14 has a tendency to become too high irrespective of the number of the club.

Furthermore, the wood set satisfy the above-mentioned conditions relating to the shaft inserting length S, that is, $$S(n=1)<S(n=m)$$

$$Sn \leqq S(n+1).$$

As the highest numbered club 12*b* has the largest hosel length Lm, the shaft inserting length Sm becomes long, and a sufficient bonding area can be obtained between the shaft 13 and the shaft inserting hole 6. In the lowest numbered wood 12*a* having the smallest hosel length L1, although the shaft inserting length S1 is shortest, owing to the increased inside diameter d1 of the shaft inserting hole 6, a sufficient bonding area can be obtained.

The ratio Sm/S1 is preferably limited in the same manner as the iron set.

Figure 7:
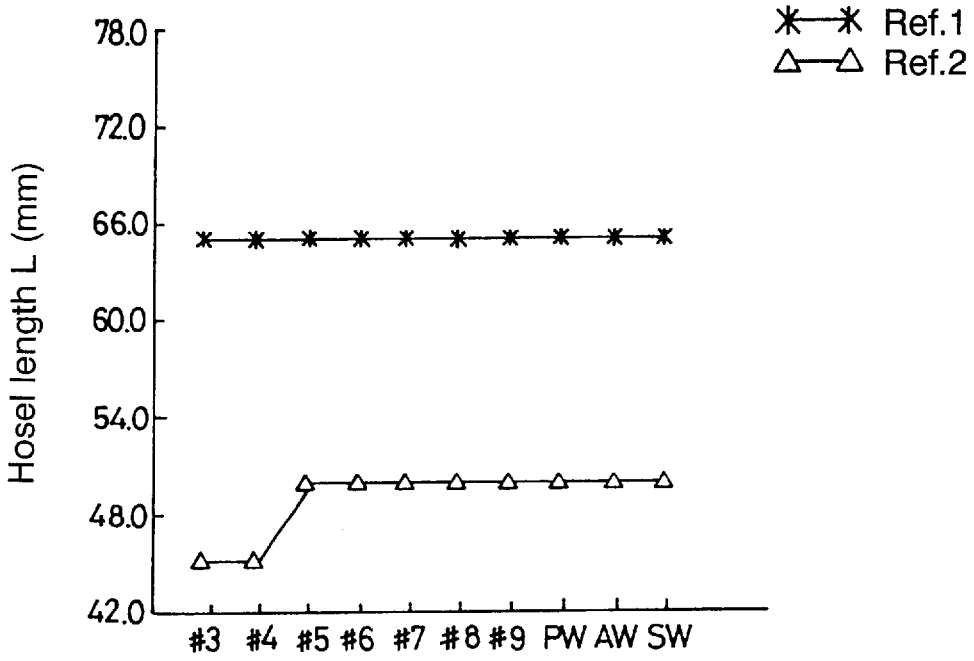
FIG. 7 show the hosel lengths of each example of the iron golf club set.
Figure 7:
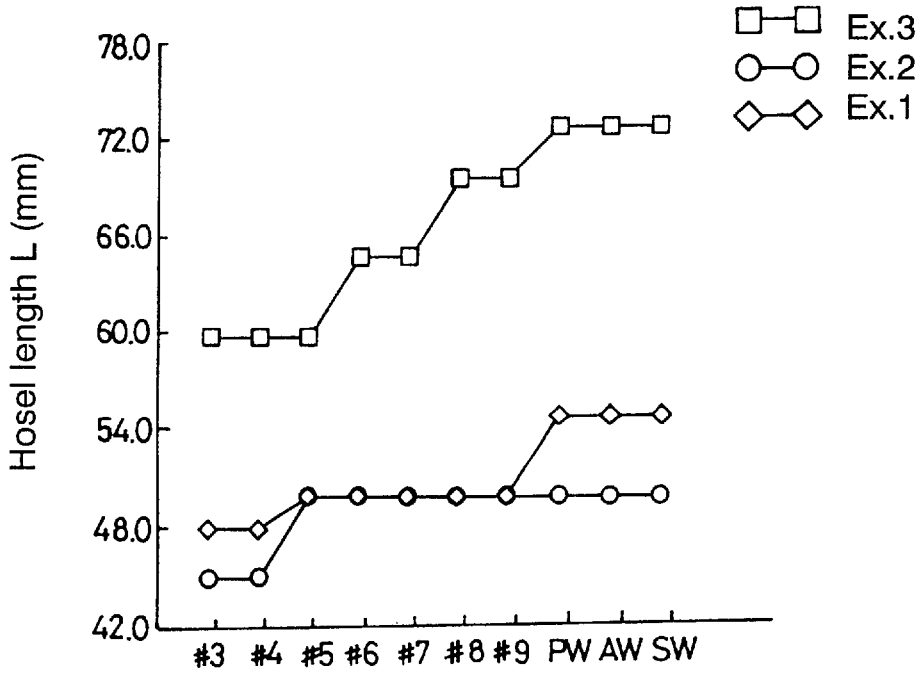
Figure 8:
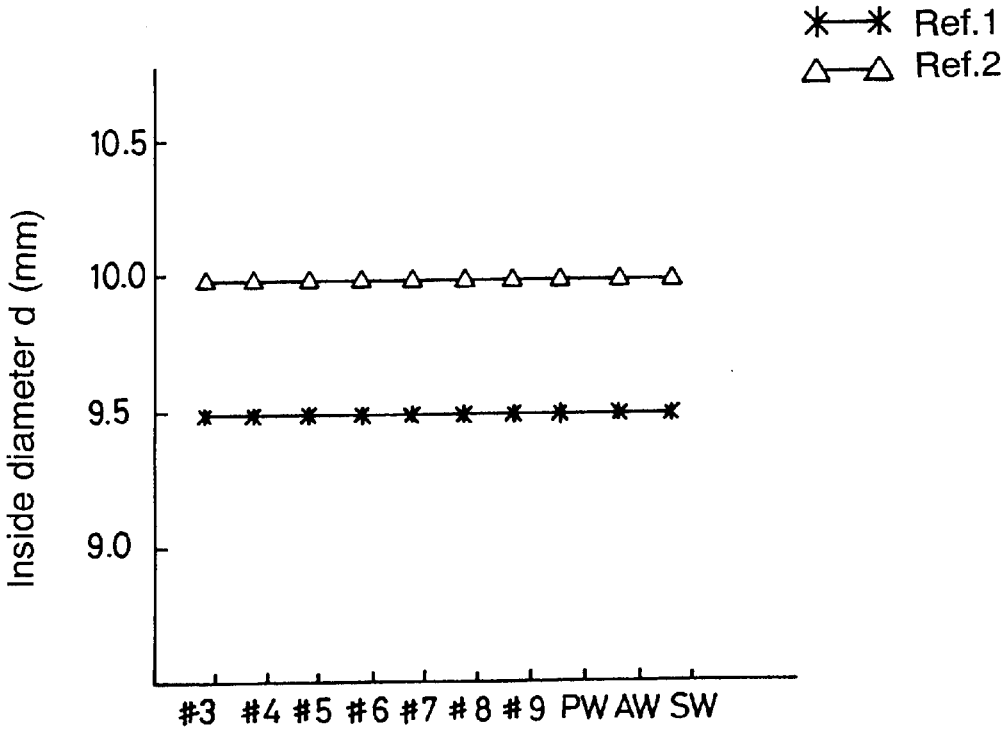
FIG. 8 show the shaft inserting holes' inside diameters thereof.
Figure 8:
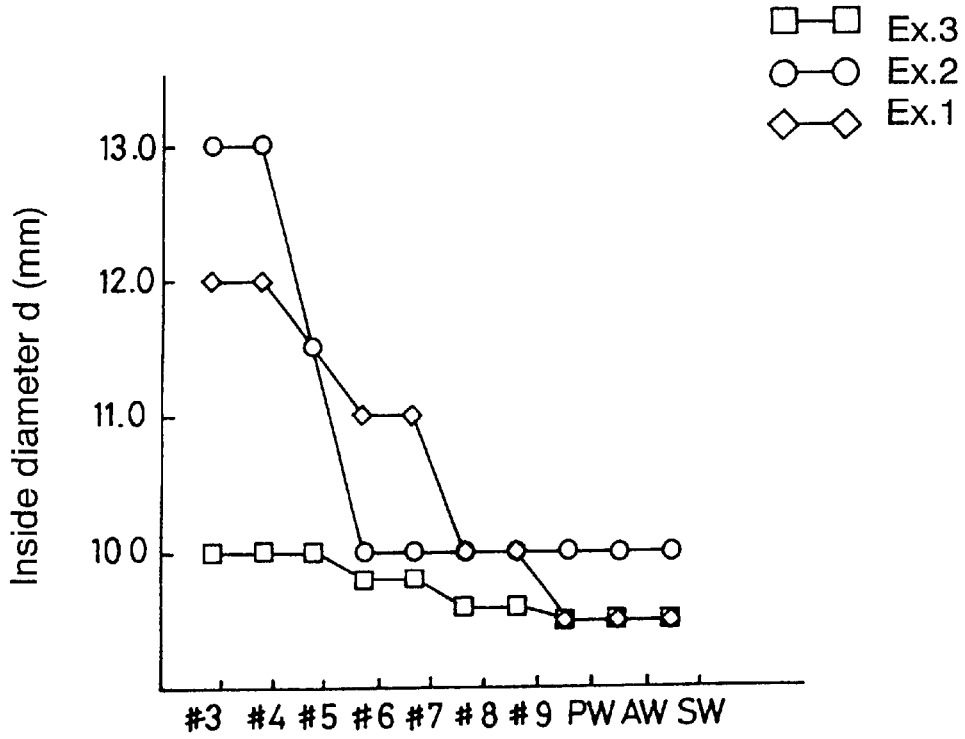
Figure 9:
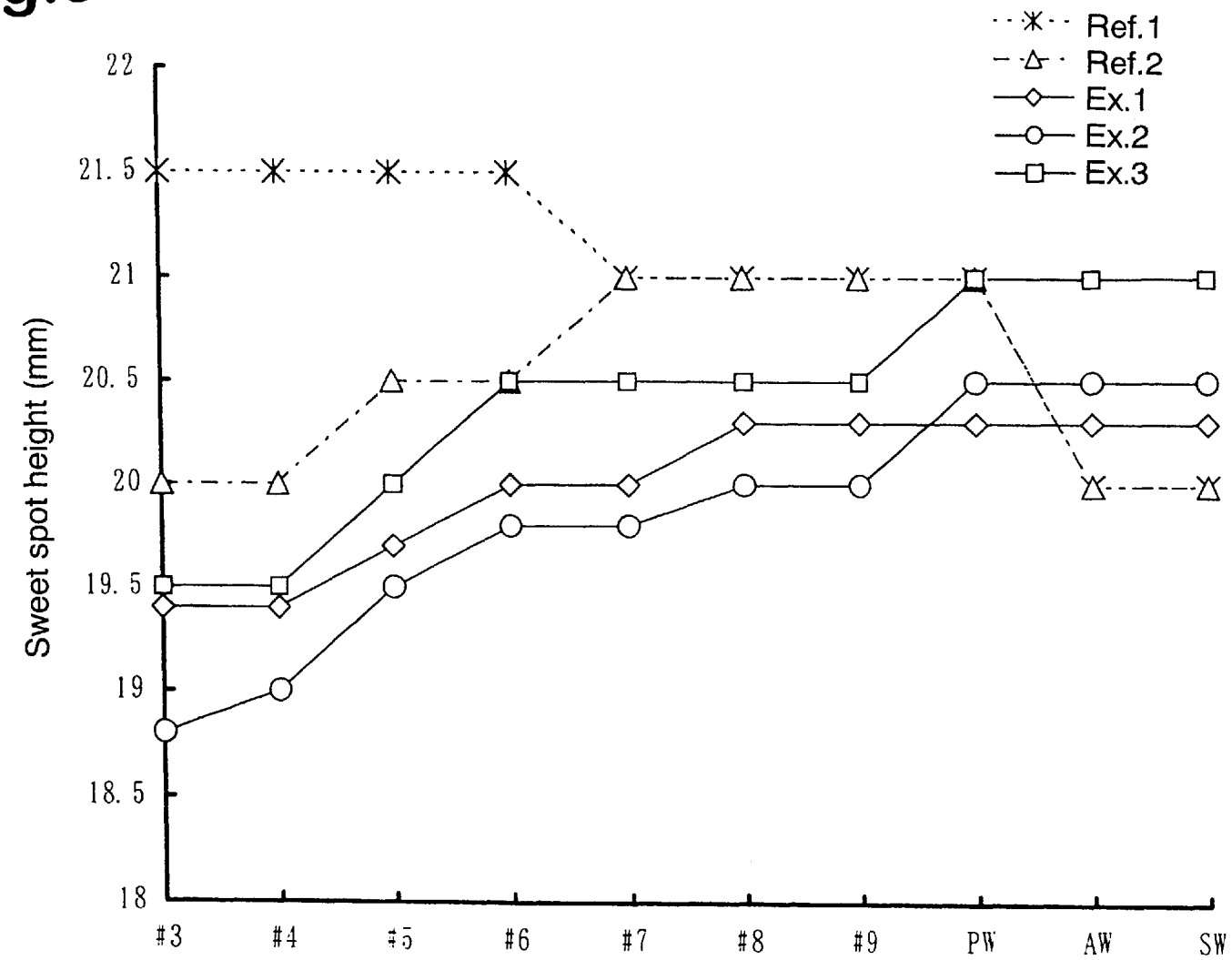
FIG. 9 shows the sweet spot heights thereof.
Figure 10:
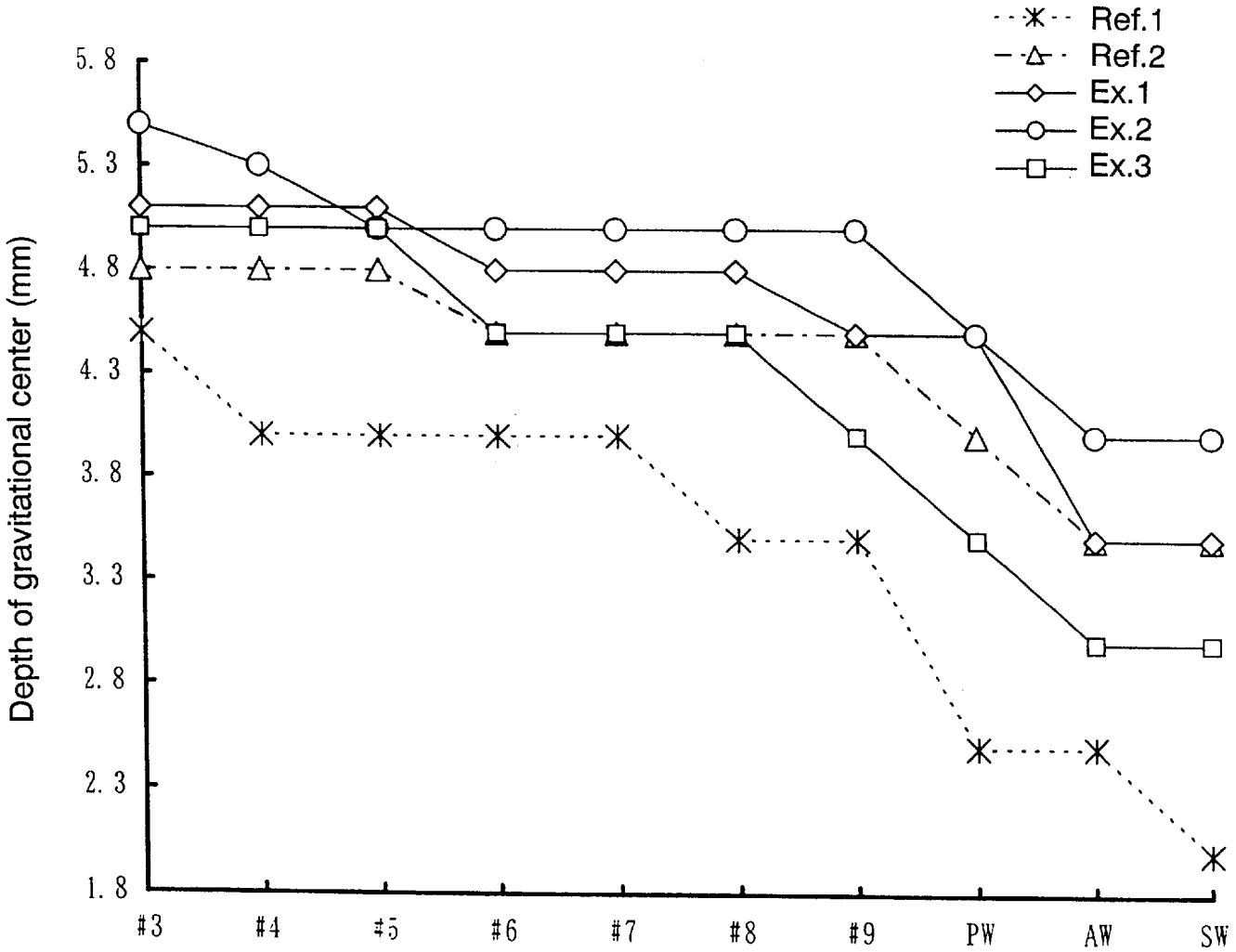
FIG. 10 shows the depths of gravitational center thereof.

As to the shaft 13 of the wood club, the above description made in the iron set in relation to the method of making the shaft, and the structure such as the main part, thick part, diameter and the like is applied here again.

formed by a titan plate. In only Ref. 2, a weight made of tungsten-copper alloy was used as the sole of the head. The specifications are shown in Table 1. The hosel lengths L are shown in FIG. 7. The inside diameters (d) of the shaft inserting holes are shown in FIG. 8. The sweet spot heights (h) are shown in FIG. 9. The depths F of gravitational center G are shown in FIG. 10.

The sweet spot height (h) is the vertical height of the sweet spot PS (see club #6 in FIG. 2). The sweet spot PS is the intersecting point of a line and the face 5, which line is drawn perpendicular to the face 5 from the gravitational center G of the head. The depth (F) of the gravitational center G is the length of the perpendicular line drawn from the gravitational center G to the sweet spot PS.

TABLE 1

| | Club | | | | | | | | | |
|---|---|---|---|---|---|---|---|---|---|---|
| | #3 | #4 | #5 | #6 | #7 | #8 | #9 | PW | AW | SW |
| | Loft angle (deg) | | | | | | | | | |
| | 20 | 23 | 26 | 29 | 32 | 36 | 40 | 45 | 51 | 56 |
| Ex.1 | | | | | | | | | | |
| Hosel length L (mm) | 48 | 48 | 50 | 50 | 50 | 50 | 50 | 55 | 55 | 55 |
| Inside diameter d (mm) | 12 | 12 | 11.5 | 11 | 11 | 10 | 10 | 9.5 | 9.5 | 9.5 |
| Inserting length S (mm) | 22 | 22 | 23 | 24 | 24 | 26.4 | 26.4 | 27.8 | 27.8 | 27.8 |
| Bonding area (sq.mm) | 829 | 829 | 831 | 830 | 830 | 830 | 830 | 830 | 830 | 830 |
| Sweet spot height (mm) | 19.4 | 19.4 | 19.7 | 20 | 20 | 20.3 | 20.3 | 20.5 | 20.5 | 20.5 |
| Depth of CG (mm) | 5.1 | 5.1 | 5.1 | 4.8 | 4.8 | 4.8 | 4.5 | 4.5 | 3.5 | 3.5 |
| Ex.2 | | | | | | | | | | |
| Hosel length L (mm) | 45 | 45 | 50 | 50 | 50 | 50 | 50 | 50 | 50 | 50 |
| Inside diameter d (mm) | 13 | 13 | 11.5 | 10 | 10 | 10 | 10 | 10 | 10 | 10 |
| Inserting length S (mm) | 20 | 20 | 22.5 | 26 | 26 | 26 | 26 | 26 | 26 | 26 |
| Bonding area (sq.mm) | 816 | 816 | 812 | 815 | 815 | 815 | 815 | 815 | 815 | 815 |
| Sweet spot height (mm) | 18.8 | 19 | 19.5 | 19.8 | 19.8 | 20 | 20 | 20.5 | 20.5 | 20.5 |
| Depth of CG (mm) | 5.5 | 5.3 | 5 | 5 | 5 | 5 | 5 | 4.5 | 4 | 4 |
| Ex.3 | | | | | | | | | | |
| Hosel length L (mm) | 60 | 60 | 60 | 65 | 65 | 70 | 70 | 73 | 73 | 73 |
| Inside diameter d (mm) | 10 | 10 | 10 | 9.8 | 9.8 | 9.6 | 9.6 | 9.5 | 9.5 | 9.5 |
| Inserting length S (mm) | 28 | 28 | 28 | 28.6 | 28.6 | 29.2 | 29.2 | 29.5 | 29.5 | 29.5 |
| Bonding area (sq.mm) | 879 | 879 | 879 | 879 | 879 | 879 | 879 | 879 | 879 | 879 |
| Sweet spot height (mm) | 19.5 | 19.5 | 20 | 20.5 | 20.5 | 20.5 | 20.5 | 21 | 21 | 21 |
| Depth of CG (mm) | 5 | 5 | 5 | 4.5 | 4.5 | 4.5 | 4 | 3.5 | 3 | 3 |
| Ref.1 | | | | | | | | | | |
| Hosel length L (mm) | 65 | 65 | 65 | 65 | 65 | 65 | 65 | 65 | 65 | 65 |
| Inside diameter d (mm) | 9.5 | 9.5 | 9.5 | 9.5 | 9.5 | 9.5 | 9.5 | 9.5 | 9.5 | 9.5 |
| Shaft inserting length S (mm) | 30 | 30 | 30 | 30 | 30 | 30 | 30 | 30 | 30 | 30 |
| Bonding area (sq.mm) | 895 | 895 | 895 | 895 | 895 | 895 | 895 | 895 | 895 | 895 |
| Sweet spot height (mm) | 21.5 | 21.5 | 21.5 | 21.5 | 21 | 21 | 21 | 21 | 20 | 20 |
| Depth of CG (mm) | 4.5 | 4 | 4 | 4 | 4 | 3.5 | 3.5 | 2.5 | 2.5 | 2 |
| Ref.2 | | | | | | | | | | |
| Hosel length L (mm) | 45 | 45 | 50 | 50 | 50 | 50 | 50 | 50 | 50 | 50 |
| Inside diameter d (mm) | 10 | 10 | 10 | 10 | 10 | 10 | 10 | 10 | 10 | 10 |
| Shaft inserting length S (mm) | 25 | 25 | 25 | 25 | 25 | 25 | 25 | 25 | 25 | 25 |
| Bonding area (sq.mm) | 785 | 785 | 785 | 785 | 785 | 785 | 785 | 785 | 785 | 785 |
| Sweet spot height (mm) | 20 | 20 | 20.5 | 20.5 | 21 | 21 | 21 | 21 | 20 | 20 |
| Depth of CG (mm) | 4.8 | 4.8 | 4.8 | 4.5 | 4.5 | 4.5 | 4.5 | 4 | 3.5 | 3.5 |

Examples of Iron Set

A plurality of iron sets each consists of ten iron clubs #3, #4, #5, #6, #7, #8, #9, PW, AW, SW were prepared (n=1~10). The shaft was made of a carbon fiber reinforced plastic. The head was made of SUS630 stainless steel. The face was In the Example sets 1 to 3, it was possible to gradually decrease the sweet spot height and gradually increase the depth of gravitational center from the highest numbered iron (SW) to the lowest numbered iron (#3). Especially, in the lowest numbered club, the sweet spot height could be decreased to less than 20 mm and the depth of gravitational center could be increased to more than 5 mm.

Examples of Wood Set

Figure 11:
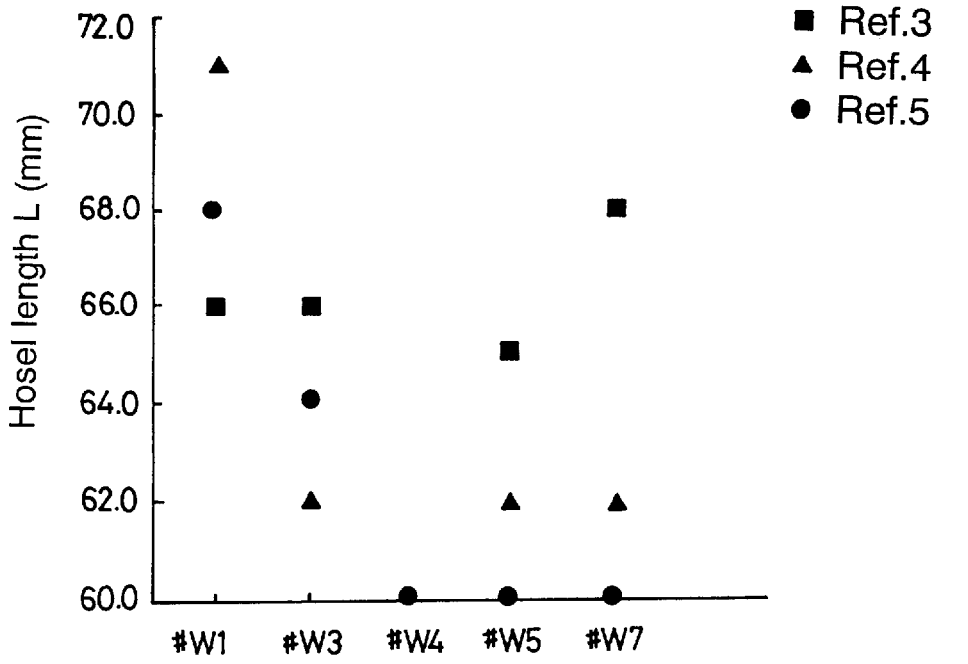
FIG. 11 show the hosel lengths of each example of the wood golf club set.
Figure 11:
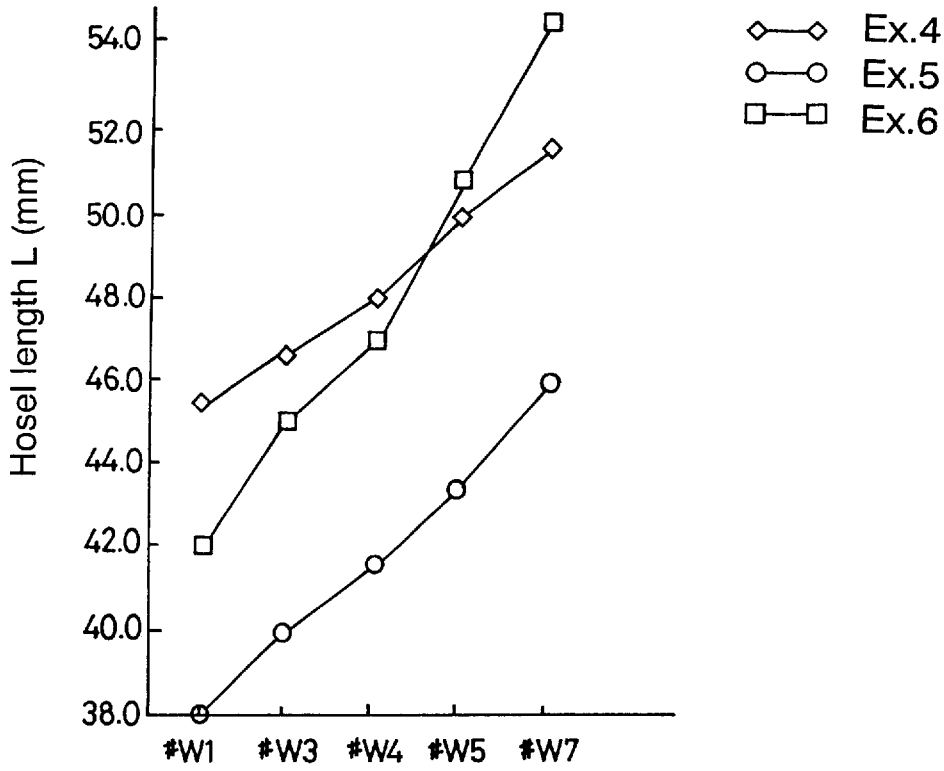
Figure 12:
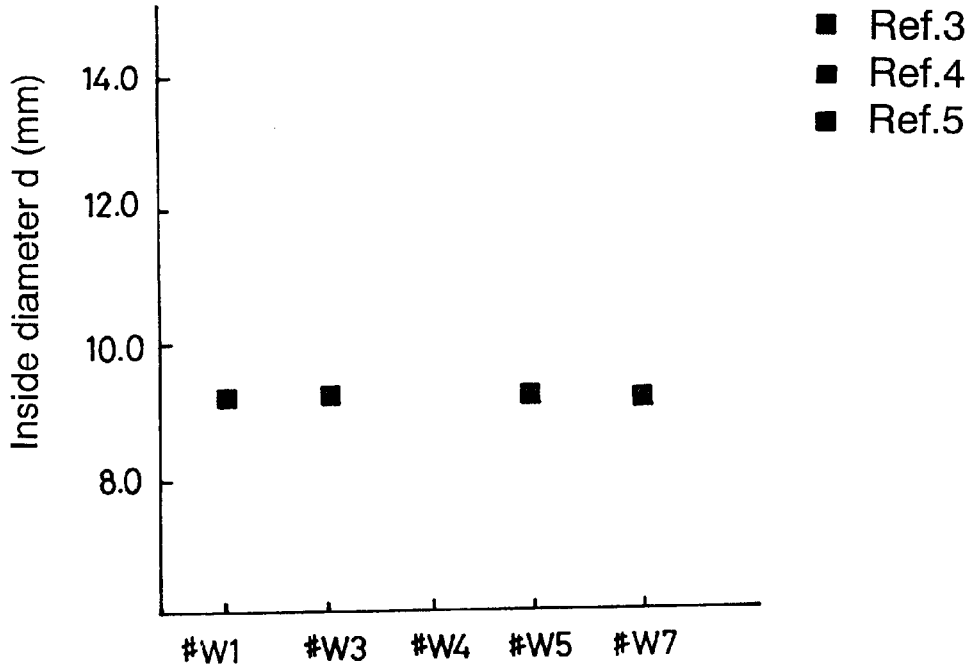
FIG. 12 show the shaft inserting holes' inside diameters thereof.
Figure 12:
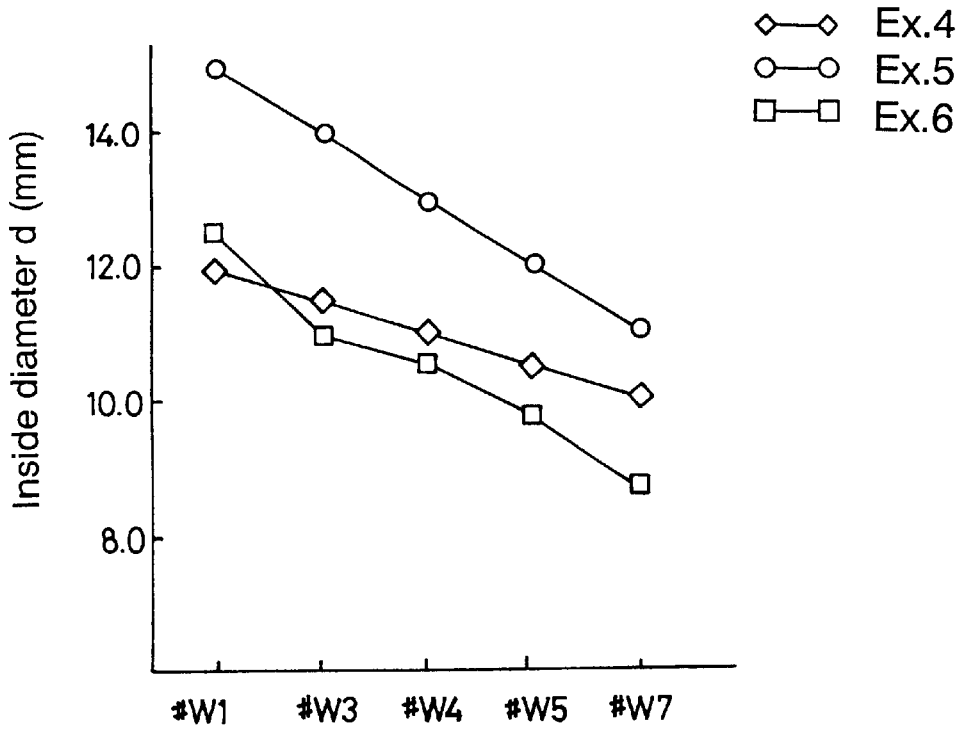
Figure 13:
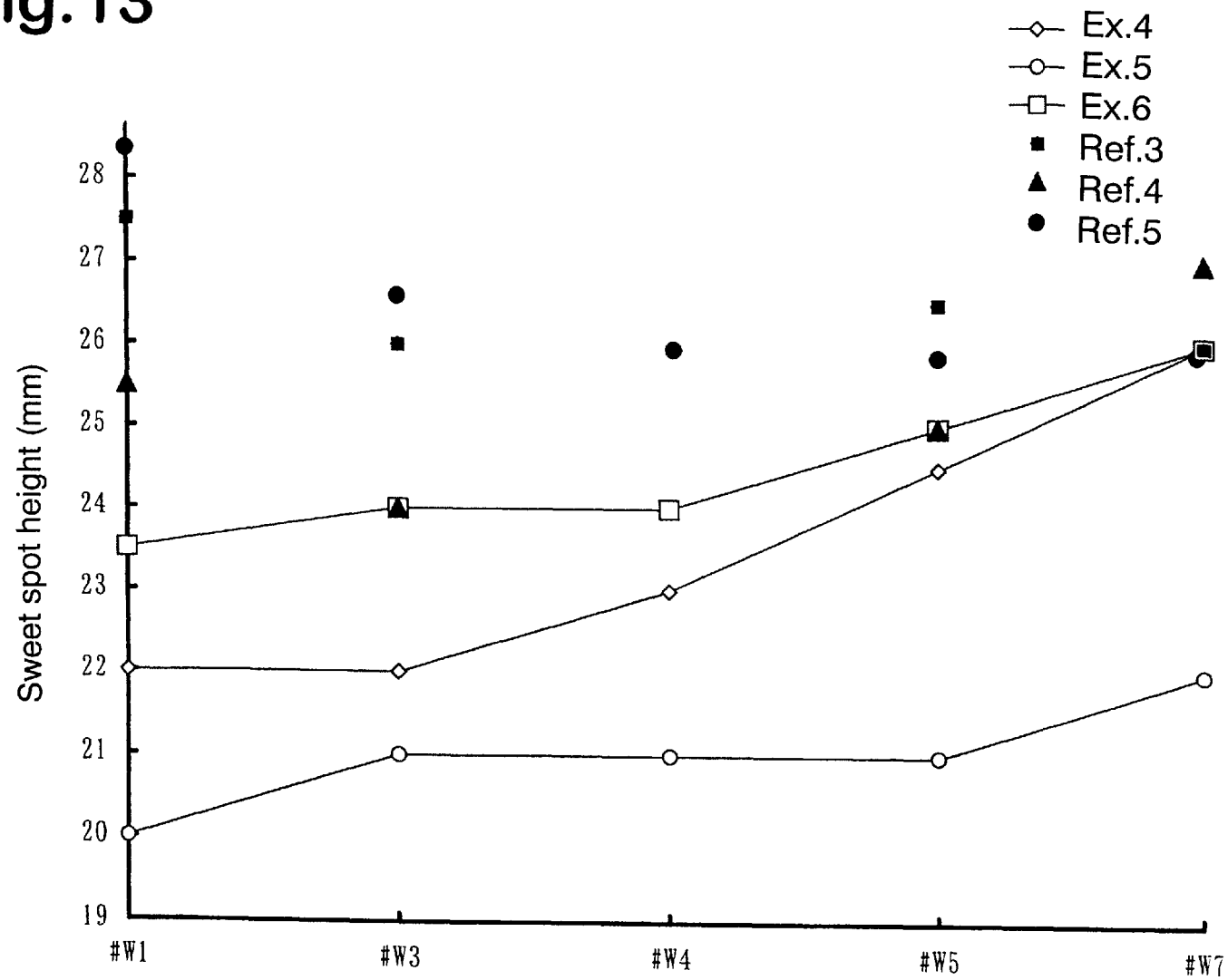
FIG. 13 shows the sweet spot heights thereof.
Figure 14:
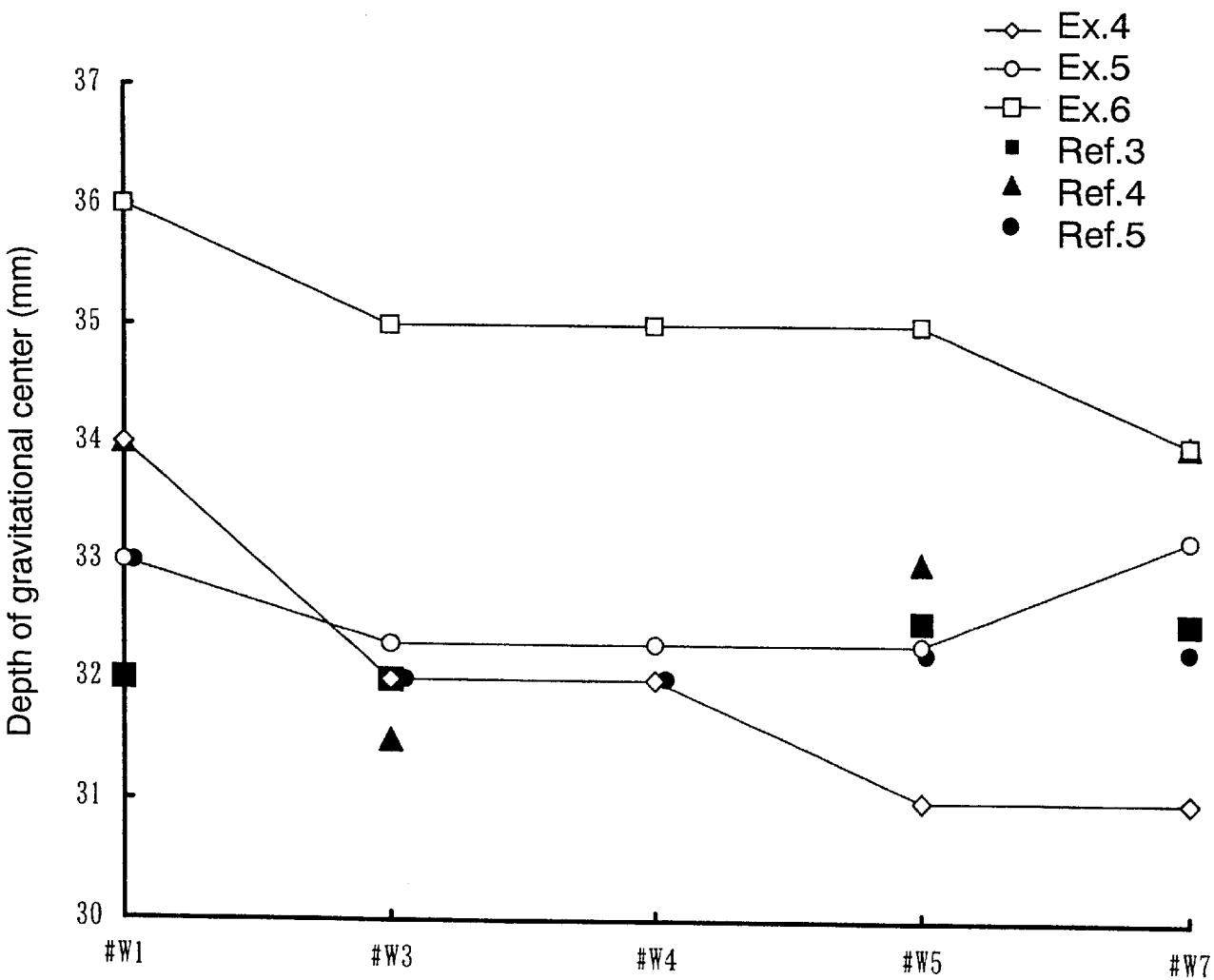
FIG. 14 shows the depths of gravitational center thereof.

A plurality of wood type golf club sets were prepared and the sweet spot height, the depth of gravitational center and the like were measured as in the same way as the iron sets. The specifications are shown in Table 2. Example sets 4 and 5 each consisted of five wood type golf clubs #W1, #W3, #W4, #W5 and #W7. Example set 6 consisted of four fairway woods #W3, #W4, #W5 and #W7 (The data of a driver #W1 are shown for reference only). The shaft was made of a carbon fiber reinforced plastic. In Ref. 3 and 4, the heads of #W3 to #W7 were made of SUS630 stainless steel, and incidentally the head of #W1 was made of titan alloy. The heads of the other sets were made of titan alloy (6Al-4V). The hosel lengths are shown in FIG. 11. The inside diameters of shaft inserting holes are shown in FIG. 12. The sweet spot heights are shown in FIG. 13. The depths of gravitational center are shown in FIG. 14.

As described above, in the golf club set according to the present invention, the low-numbered golf clubs become relatively easy for the average golfers to deal with. On the other hand, in the high-numbered clubs, the sweet spot height became relatively high, and accordingly, it is possible to avoid hitting the ball too high. Thus, it is possible to control the carry just as wanted by changing the club.

What is claimed is:

1. A golf club set comprising:

at least three golf clubs having different loft angles changing progressively from a smallest loft angle of a lowest numbered golf club to a largest loft angle of a highest numbered golf club, wherein each of the golf clubs comprises a shaft and a head, the head provided with a hosel having a shaft inserting hole into which the shaft is inserted, and in a standard state of each golf club in which the head is disposed on a horizontal plane so as to show a lie angle and a loft angle thereof, the clubs satisfy the following conditions:

TABLE 2

| Set | Club | #W1 | #W3 | #W4 | #W5 | #W7 |
|---|---|---|---|---|---|---|
| Ex. 4 | Loft angle (deg) | 10 | 14 | 16 | 18 | 20 |
| | Head volume (cm3) | 305 | 163 | 148 | 135 | 129 |
| | Hosel length L (mm) | 45.5 | 46.5 | 48 | 50 | 51.5 |
| | Inside diameter d (mm) | 12 | 11.5 | 11 | 10.5 | 10 |
| | Shaft inserting length S (mm) | 27 | 28 | 29.5 | 30.8 | 32.3 |
| | Bonding area (sq.mm) | 1015 | 1015 | 1015 | 1015 | 1015 |
| | Sweet spot height (mm) | 22 | 22 | 23 | 24.5 | 26 |
| | Depth of CG (mm) | 34 | 32 | 32 | 31 | 31 |
| Ex. 5 | Loft angle (deg) | 10 | 15 | 17 | 19 | 21 |
| | Head volume (cm3) | 280 | 175 | 160 | 145 | 128 |
| | Hosel length L (mm) | 38 | 40 | 41.5 | 43.5 | 46 |
| | Inside diameter d (mm) | 15 | 14 | 13 | 12 | 11 |
| | Shaft inserting length S (mm) | 20.8 | 22.3 | 24 | 26 | 28.5 |
| | Bonding area (sq.mm) | 980 | 980 | 980 | 980 | 980 |
| | Sweet spot height (mm) | 20 | 21 | 21 | 21 | 22 |
| | Depth of CG (mm) | 33 | 32.3 | 32.3 | 32.3 | 33.2 |
| Ex. 6 | Loft angle (deg) | 10 | 15 | 17 | 19 | 21 |
| | Head volume (cm3) | 310 | 170 | 155 | 145 | 130 |
| | Hosel length L (mm) | 42 | 45 | 47 | 51 | 55 |
| | Inside diameter d (mm) | 12.5 | 11 | 10.5 | 9.5 | 8.6 |
| | Shaft inserting length S (mm) | 27 | 30.7 | 32 | 35.5 | 38 |
| | Bonding area (sq.mm) | 1060 | 1060 | 1060 | 1060 | 1060 |
| | Sweet spot height (mm) | 23.5 | 24 | 24 | 25 | 26 |
| | Depth of CG (mm) | 36 | 35 | 35 | 35 | 34 |
| Ref. 3 | Loft angle (deg) | 10 | 15 | — | 21 | 24 |
| | Head volume (cm3) | 245 | 120 | — | 105 | 95 |
| | Hosel length L (mm) | 66 | 66 | — | 65 | 68 |
| | Inside diameter d (mm) | 8.6 | 8.6 | — | 8.6 | 8.6 |
| | Shaft inserting length S (mm) | 38 | 36 | — | 36 | 36 |
| | Bonding area (sq.mm) | 1027 | 973 | — | 973 | 973 |
| | Sweet spot height (mm) | 27.5 | 26 | — | 26.5 | 26 |
| | Depth of CG (mm) | 32 | 32 | — | 32.5 | 32.5 |
| Ref. 4 | Loft angle (deg) | 11 | 16 | — | 18 | 20 |
| | Head volume (cm3) | 270 | 165 | — | 150 | 130 |
| | Hosel length L (mm) | 71 | 62 | — | 62 | 62 |
| | Inside diameter d (mm) | 8.6 | 8.6 | — | 8.6 | 8.6 |
| | Shaft inserting length S (mm) | 38 | 38 | — | 38 | 38 |
| | Bonding area (sq.mm) | 1027 | 1027 | — | 1027 | 1027 |
| | Sweet spot height (mm) | 25.5 | 24 | — | 25 | 27 |
| | Depth of CG (mm) | 34 | 31.5 | — | 33 | 34 |
| Ref. 5 | Loft angle (deg) | 10 | 15 | 17 | 19 | 21 |
| | head volume (cm3) | 280 | 175 | 160 | 145 | 128 |
| | Hosel length L (mm) | 68 | 64 | 60 | 60 | 60 |
| | Inside diameter d (mm) | 8.6 | 8.6 | 8.6 | 8.6 | 8.6 |
| | Shaft inserting length S (mm) | 38 | 36 | 36 | 36 | 36 |
| | Bonding area (sq.mm) | 1027 | 973 | 973 | 973 | 973 |
| | Sweet spot height (mm) | 28.5 | 26.5 | 26 | 26 | 26 |
| | Depth of CG (mm) | 33 | 32 | 32 | 32.5 | 32.5 |

$$Ln \leqq L(n+1)$$

$$L(n=1) < L(n=m)$$

$$dn \geqq d(n+1)$$

$$d(n=1) > d(n=m)$$

Wherein

L is a hosel length, d is an inside diameter of a shaft inserting hole, m is the number of the golf clubs, and Suffix "n" to "L" and "d" means the order number of the club in the ascending order from the lowest numbered club (n=1) to the highest numbered club (n=m), and the hosel length of each club is defined as a length measured from the upper end of the hosel to the horizontal plane along the central axis of the shaft, and a bonding area of the shaft to the shaft inserting hole is substantially constant from the lowest numbered golf club to the highest numbered golf club.

2. The golf club set according to claim 1, wherein the hosel length L(n=m) of the highest numbered golf club is in a range of from 1.05 to 1.50 times the hosel length L(n=1) of the lowest numbered golf club.

3. The golf club set according to claim 2, wherein a length S of a part of the shaft in the shaft inserting hole is increased from the lowest numbered golf club to the highest numbered golf club to satisfy the following conditions:

$$Sn \leqq S(n+1)$$

$$S(n=1) < S(n=m).$$

4. The golf club set according to claim 3, wherein the shaft inserted length S(n=m) of the highest numbered golf club is in a range of from 1.05 to 1.50 times the shaft inserted length S(n−1) of the lowest numbered golf club, and the inside diameter d(n=1) of the shaft inserting hole of the lowest numbered golf club is in a range of from 1.05 to 1.50 times the inside diameter d(n=m) of the shaft inserting hole of the highest numbered golf club.

5. The golf club set according to claim 1, which consists of iron golf clubs.

6. The golf club set according to claim 1, which comprises at least three fairway wood clubs.

7. A golf club set comprising:

at least three golf clubs having different loft angles changing progressively from a smallest loft angle of a lowest numbered golf club to a largest loft angle of a highest numbered golf club, wherein each of the golf clubs comprises a shaft and a head, the head provided with a hosel having a shaft inserting hole into which the shaft is inserted, and in a standard state of each golf club in which the head is disposed on a horizontal plane so as to show a lie angle and a loft angle thereof, the clubs satisfy the following conditions:

$$Ln \leqq L(n+1)$$

$$L(n=1) < L(n=m)$$

$$dn \leqq d(n+1)$$

$$d(n=1) > d(n=m)$$

Wherein

L is a hosel length, d is an inside diameter of a shaft inserting hole, m is the number of the golf clubs, and Suffix "n" to "L" and "d" means the order number of the club in the ascending order from the lowest numbered club (n=1) to the highest numbered club (n=m), the hosel length of each club is defined as a length measured from the upper end of the hosel to the horizontal plane along the central axis of the shaft, and a length S of a part of the shaft in the shaft inserting hole is increased from the lowest numbered golf club to the highest numbered golf club to satisfy the following conditions:

$$Sn \leqq S(n+1)$$

$$S(n=1) < S(n=m).$$

8. The golf club set according to claim 7, wherein the shaft inserted length S(n=m) of the highest numbered golf club is in a range of from 1.05 to 1.50 times the shaft inserted length S(n=1) of the lowest numbered golf club, and the inside diameter d(n=1) of the shaft inserting hole of the lowest numbered golf club is in a range of from 1.05 to 1.50 times the inside diameter d(n=m) of the shaft inserting hole of the highest numbered golf club.

9. The golf club set according to claim 7, wherein a bonding area of the shaft to the shaft inserting hole is substantially constant from the lowest numbered golf club to the highest numbered golf club.

10. The golf club set according to claim 7, which consists of iron golf clubs.

11. The golf club set according to claim 7, which comprises at least three fairway wood clubs.

* * * * *